US006322154B1

(12) United States Patent
Alderman et al.

(10) Patent No.: US 6,322,154 B1
(45) Date of Patent: Nov. 27, 2001

(54) MODIFIED WHEELS FOR ICE

(76) Inventors: Richard L. Alderman, 3062 Artesian La., Madison, WI (US) 53713; Donald C. Hue, 4827 Helgeland Dr., Sun Prairie, WI (US) 53590

( * ) Notice: Subject to any disclaimer, the term of this patent is extended or adjusted under 35 U.S.C. 154(b) by 0 days.

(21) Appl. No.: 09/666,259

(22) Filed: Sep. 21, 2000

(51) Int. Cl.[7] ..... A63C 17/22; A63C 17/18; A63C 17/02; A62K 13/00

(52) U.S. Cl. ..... 301/5.303; 301/5.301; 280/7.13; 280/11.221

(58) Field of Search ..... 301/5.1, 5.301, 301/5.302, 5.303 I; 280/7.13, 841, 600, 11.19, 11.221

(56) References Cited

U.S. PATENT DOCUMENTS

| | | | | |
|---|---|---|---|---|
| 1,489,197 | * | 4/1924 | Daverkosen et al. | 280/11.22 |
| 2,152,684 | * | 4/1939 | Grange et al. | 301/5.3 |
| 2,377,366 | * | 6/1945 | Paystrup | 280/11.25 |
| 2,448,222 | * | 8/1948 | Jones | 301/5.3 |
| 3,907,369 | * | 9/1975 | Chevaux | 301/5.3 |
| 4,043,565 | * | 8/1977 | Mogannam | 280/11.12 |
| 4,805,934 | * | 2/1989 | Mullenax | 280/7.12 |
| 5,259,632 | * | 11/1993 | Mahoney | 280/7.14 |
| 5,411,320 | * | 5/1995 | Alderman et al. | 301/5.3 |
| 5,901,970 | * | 5/1999 | Henshaw | 280/11.19 |
| 5,915,702 | * | 6/1999 | Kirschling et al. | 280/11.22 |

FOREIGN PATENT DOCUMENTS

| | | | | |
|---|---|---|---|---|
| 39995-A | * | 7/1887 | (GB) | 280/7.13 |
| 1120895-A | * | 7/1968 | (GB) | 301/5.3 |

* cited by examiner

*Primary Examiner*—S. Joseph Morano
*Assistant Examiner*—Jason R. Bellinger

(57) ABSTRACT

The "MODIFIED WHEELS FOR ICE" consists of a wheel assembly which permits interchange with in-line skate wheels for use on ice that minimizes damage from fractures in the ice, particularly when the wheel is at an angle from perpendicular to the ice while pushing off or turning. The wheel is consists of a lightweight hub, bearing accommodating counterbores and an outer ring containing multiple contact means. When the wheel is at an angle from perpendicular to the ice the outer circumferential contact means being smaller in diameter than the inner circumferential contact means allows both contact means to engage the ice. A new load bearing support surface is both adjacent to the inner and outer circumferential contact means and parallel to the ice when the wheel is at a predetermined angle from perpendicular to the ice. The function of the support surface is to limit the penetration of the contact means into the ice. The distance between the contact means, the depth of their penetration into the ice and the interaction of the support surface with the ice contribute significantly limit the damage to the ice by fracturing.

5 Claims, 3 Drawing Sheets

MODIFIED WHEELS FOR ICE

BACKGROUND OF THE INVENTION

The present invention relates to a modified wheel for use on ice that limits the fracturing of the ice for acceptable use at ice rinks. Particularly, a wheel especially suited for a conversion of in-line skates, where a conversion to the wheels as described in this invention would permit the use of ice, as a surface medium, for locomotion.

U.S. Pat. No. 5,411,320 to Alderman et al. on May 2, 1995 describes a wheel for use on ice with multiple contact means including one of a smaller diameter on each side for additional lateral friction while pushing off at an angle. Additionally, the distance between the contact means engaged in the ice while the skate is perpendicular to the ice is wider than that of a standard ice blade to provide better stability. Said wheels, although providing sufficient lateral friction, unacceptably fracture the ice while executing turns or pushing off. Such fracture, which occurs between adjacent contact means when the skate is at an angle, causes unacceptable damage to the ice. Said adjacent contact means lack a support surface when the ice-engaging structure is operated at an angle to minimize fracturing of the ice.

German Patent No. 39,995 to Schramm et al. on Nov. 9, 1886 describes a convertible roller ice skate that uses either a blade or two concave grooved in-line wheels, per skate, for use on ice. The wheels as described in this patent are single concave grooved wheels that provide only one edge in contact with the ice while the skater is pushing off at an angle.

Great Britain Patent No. 1,120,895 to Makuba N. V. on Jul. 24, 1968 describes a roller ice skate having two or more wheels all of which are arranged one behind the other in a single row. A sharp peripheral ridge enables a push off action to be obtained when skating. This patent describes a wheel that only has one edge in contact with the ice while the skater is pushing off at an angle.

U.S. Pat. No. 1,489,197 to Daverkosen et al. on Apr. 1, 1924 describes a type of ice skate that comprises a roller skate frame, two ball bearing rollers mounted on the front and rear of the frame and each of said rollers being grooved differentially. This patent describes a roller skate with multiple grooves but the wheels lack multiple edges in contact with the ice if the wheels are at an angle perpendicular to the ice.

U.S. Pat. No. 2,377,366 to Paystrup on Jun. 5, 1945 describes an all-season combination ice and roller skate comprising a foot plate, a single pair of front and rear wheels under said plate, each having a flat felly. A band of the same width as said felly, and a relatively narrower band fitted around the first band and centered thereon, said bands having squarely sharpened outer edges for digging into the ice under tilting of the wheels sideways. The wheel of this patent lacks sufficient friction while it is perpendicular to the ice. These skates, with their squarely sharpened edges, would need to be tilted to about 45 degrees, an angle at which there is little downward force, for the edges to be at an optimum angle for maximum friction. At a desired 15 to 25 degrees from perpendicular there is insufficient lateral friction for executing tight turns and pushing off. While this patent has multiple edges in contact with the ice when the wheel is at an angle to the ice it does not provide a support surface.

U.S. Pat. No. 4,043,565 to Mogannam on Aug. 23, 1977 describes a recreational device with two blades attached to the front and rear axles of a device similar to a skateboard.

The blades are shown as round, oval or being generally polygonal in profile with each side of said polygon being convexly accurate with a thickness that enables concave sharpening. In this patent the wheels have only one edge in contact with the ice while the skater is pushing off at an angle.

U.S. Pat. No. 4,805,934 to Mullenax on Feb. 21, 1989 describe a skateboard with wheels for ice mounted on both sides of the front and rear axle. This patent describes wheels with multiple grooves but the wheels lack multiple edges in contact with the ice if the wheels are at an angle from perpendicular to the ice.

U.S. Pat. No. 5,259,632 to Mahoney on Nov. 9, 1993 describes a skateboard adapted for use on ice that utilizes a blade assembly comprising of a bushing member, a blade member and a body member. In the embodiment that represents a wheel the disk-shaped blade member is sandwiched by the body member, which encompasses part of the bushing member, leaving a portion of the blade member exposed for contact with the ice. This patent also addresses the adaptation of wheels for use on ice that are mounted on both sides of the front and rear axle. The need for use of a body member as a lightweight structural support for the blade member would be negated by the sufficient strength of the blade member if the blade member were made sufficiently wide so as to provide stability for the in-line ice-skater. This patent describes a wheel that has only edge in contact with the ice while the skater is pushing off at an angle.

U.S. Pat. No. 5,915,702 to Kirschling et al. on Jun. 29, 1999 describes an in-line skate and wheel for use on ice. This patent has a single circular blade that lacks multiple edges in contact with the ice when the wheels are at an angle perpendicular to the ice.

Prior art, while solving the problem of sufficient lateral friction, creates or amplifies the problem of excessive fracturing of the ice. Especially the fracturing which occurs between two contact means while pushing off or turning. Additionally, the prior art does not address the problems with sharpening a wheel for ice, as it is obvious that current sharpening machines are intended for blades.

This invention is not disclosed in any one patent or prior art disclosure. Also this invention does not combine one or more prior art patents in order to disclose all the features of this invention. U.S. Pat. Nos. 1,489,189 (Daverkosen), 2,377,366 (Paystrup), 4,043,565 (Mogannam), 4,805,934 (Mullenax), 5,259,632 (Mahoney), 5,411,320 (Alderman et al.), 5,915,702 (Kirschling et al.); Foreign Patents, Germany No. 39,995(Herm et al.), and British No. 1, 120,895 (Makuba N. V.), could not be so combined.

BRIEF SUMMARY OF THE INVENTION

The object of this invention is to provide a modified wheel that is interchangeable with a standard wheel of a standard in-line skate that limits the fracturing of the ice resulting from lateral shear stresses while turning or pushing off.

Another object of this invention is to allow an economical change of the ice-engaging structures. This is accomplished by either screwing, pressing on or the use of a retaining device such as screws to hold the ice-engaging structures on the wheel. Thus eliminating the need for costly sharpening machines, lowering the weight of the wheels by negating the need for sharpening stock and giving quality control of the ice-engaging surfaces to the manufacturer.

To achieve the object of the invention there is a modified wheel for use on ice comprising a bore and counterbore for an axle and bearings, a hub made of a lightweight material, and a removable outer ring containing ice-engaging structures that are substantially harder than ice. The ice-engaging structures comprise of a outer circumferential contact means, inner circumferential contact means and a support surface. The outer circumferential contact means and inner circumferential means are arranged so that at least two contact means are in contact with the ice surface when the wheel is perpendicular to the ice and also when the wheel is at a predetermined angle from perpendicular to the ice. A support surface is directly adjacent to the outer circumferential contact means and the inner circumferential contact means and parallel to the ice surface when the outer circumferential contact means and inner circumferential contact means are embedded in the ice.

To solve the problem of excessive fracturing of the ice the depth of the support structure, which minimizes the penetration into the ice, and the distance between the outer circumferential contact means and inner circumferential contact means are held to a minimum proportional relationship.

Due to the addition of the support surface, the fracturing of the ice is effectively limited with this wheel that is intended primarily for in-line skates. The removable ice-engaging structures allow for the economical mass production of their replacement and a tighter control over the configuration of said ice-engaging surfaces. Thus we have a wheel that is suitable for skating on ice at ice rinks, due to the limited fracturing of the ice, and a method for maintaining the sharpness, because of the removable ice-engaging structures.

DETAILED DESCRIPTION OF THE INVENTION

Figure 1:
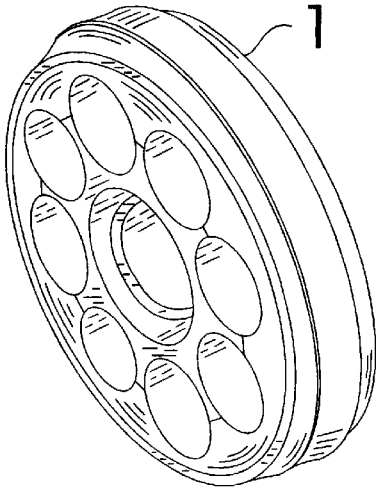
FIG. 1 is an isometric view of the modified wheel for ice.
Figure 2:
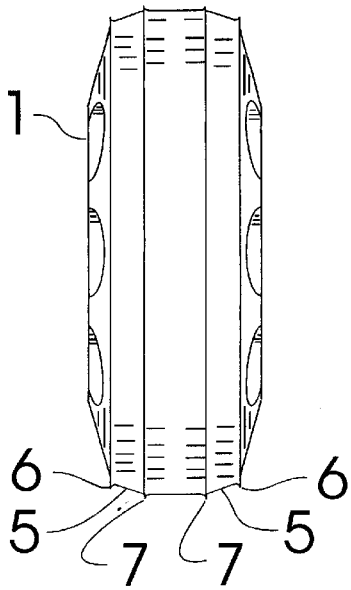
FIG. 2 is a front view of the modified wheel in FIG. 1 as viewed from a point perpendicular to the center of the axis.
Figure 3:
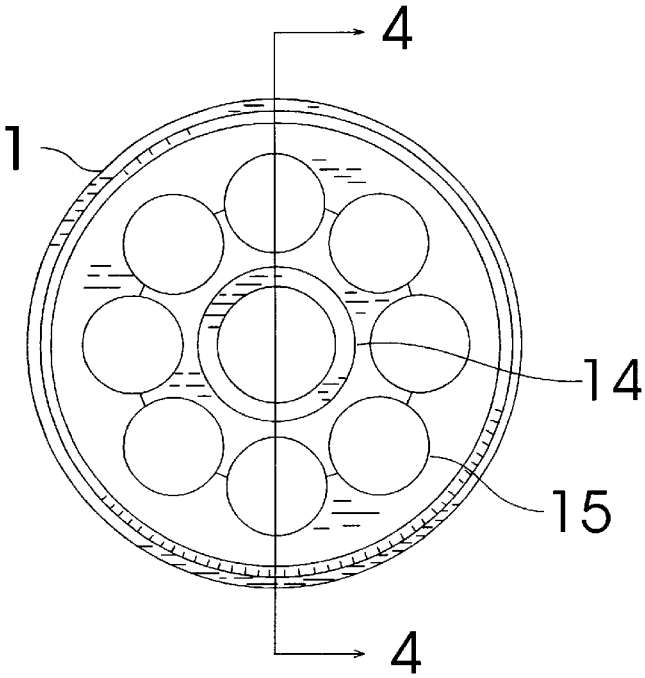
FIG. 3 is a side view of the modified wheel.
Figure 4:
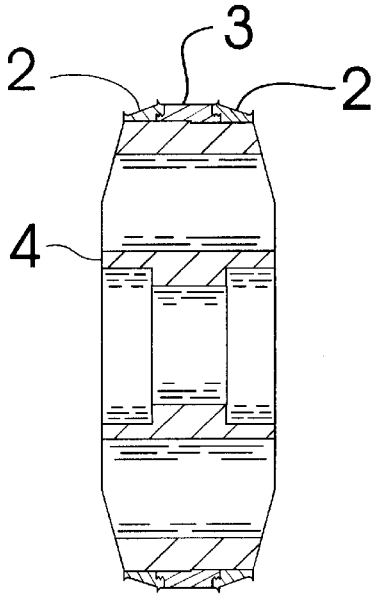
FIG. 4 is a sectional of the modified wheels a designated "section 4—4" in FIG. 3.
Figure 5:
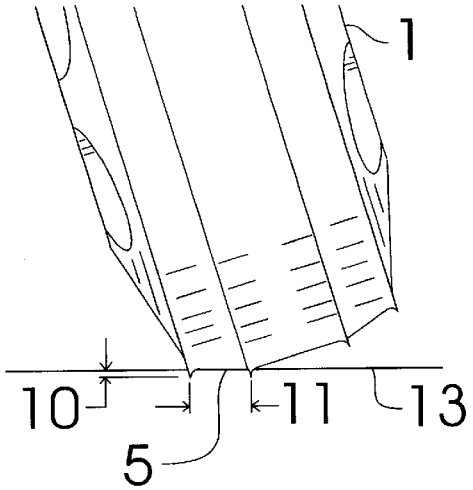
FIG. 5 is an enlarged view showing the modified wheel embedded in the ice at an angle.
Figure 6:
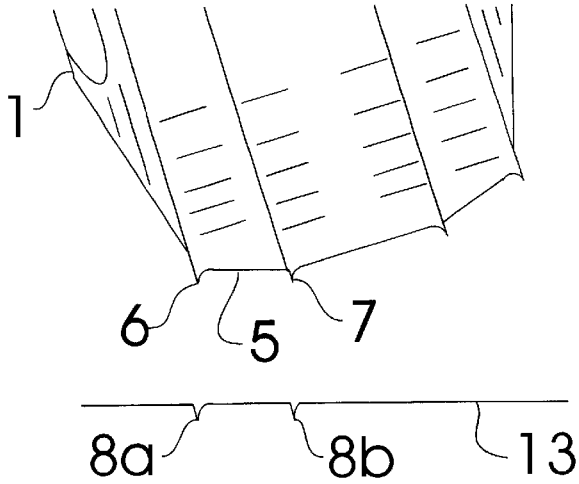
FIG. 6 is an enlarged view of the modified wheel showing the ice-engaging structure and resultant grooves from the wheel embedded in the ice.
Figure 7:
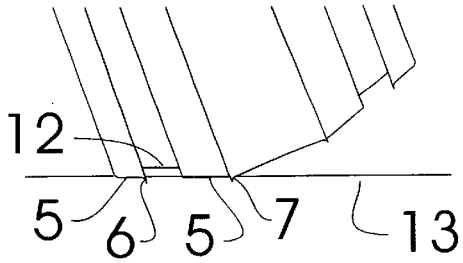
FIG. 7 is an enlarged view of an another possible configuration of the ice-engaging structure suited for wider wheels.
Figure 8A:
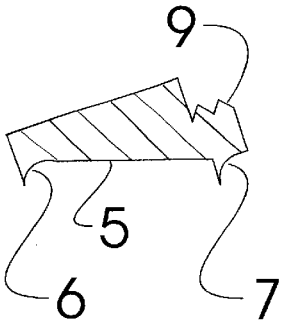
FIG. 8A is an enlarged partial view of the contact means ring,as depicted in FIG. 4, showing the flat and radiused surfaces of the contact means, the support surface and a threaded surface.
Figure 8B:
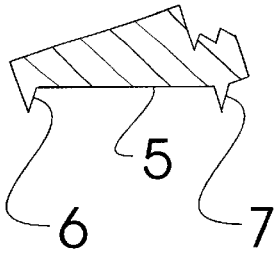
FIG. 8B is an enlarged partial view of the contact means ring, as depicted in FIG. 4, showing the angled surfaces of the contact means, the support surface and a threaded surface.
Figure 8C:
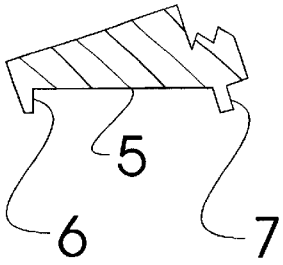
FIG. 8C is an enlarged partial view of the contact means ring, as depicted in FIG. 4, showing the flat surfaces of the contact means, the support surface and a threaded surface.
Figure 10:
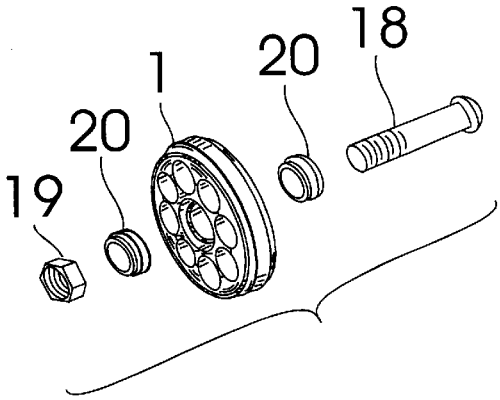
FIG. 10 is an exploded isometric view of the modified wheel including a typical axle, locknut and bearings.
Figure 9:
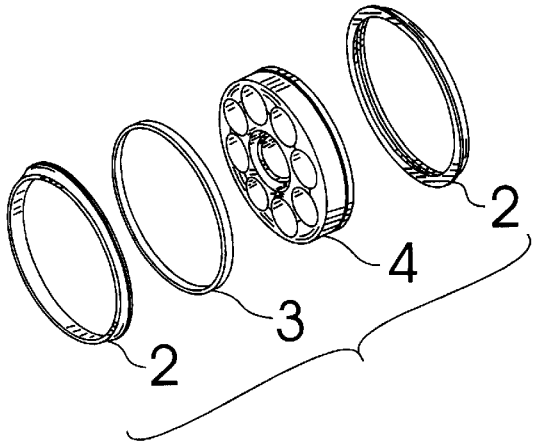
FIG. 9 is an exploded isometric view of the modified wheel showing the hub, contact means rings and the spacer.
Figure 11:
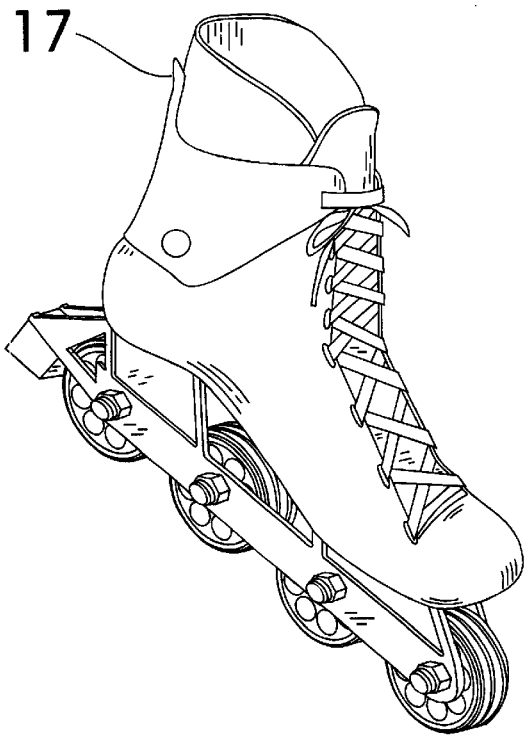
FIG. 11 is an isometric view of a typical in-line skate fitted with the modified wheels.
Figure 12:
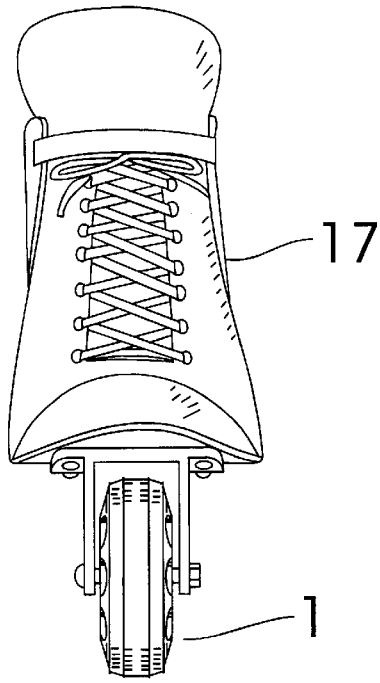
FIG. 12 is a front view of FIG. 10.

FIG. 1 shows the modified wheel (1) with an ice-engaging structure consisting of a support surface (5), outer circumferential contact means (6) and inner circumferential contact means (7), see FIG. 2, FIG. 6, FIG. 7, FIG. 8A, FIG. 8B and FIG. 8C. The support surface (5) is directly adjacent to both the outer circumferential contact means (6) and inner circumferential contact means (7), FIG. 6 and FIG. 7. A relief groove (12), FIG. 7, disposed between the outer circumferential contact means (6) and the inner circumferential contact means (7), necessitates the use of multiple support surfaces (5), so long as a support surface (5) is directly adjacent to both the outer circumferential contact means (6) and inner circumferential contact means (7). The support surface (5) is parallel to and in contact with the ice (13), as shown in FIG. 5, when the outer circumferential contact means (6) and the inner circumferential contact means (7) are fully embedded in the ice (13) with the wheel (1) at a predetermined angle from perpendicular to the ice (13). This support surface (S) helps to minimize the depth (10), FIG. 5, of the grooves (8*a*)(8*b*) formed by the outer circumferential contact means (6) and inner circumferential contact means (7). In FIG. 5, a minimum distance (11) between the grooves (8*a*)(8*b*) in combination with minimized depth (10) of the grooves (8*a*)(8*b*) and the compression of the ice (13) from the support surface (5) minimizes the size and amount of fractures between the grooves (8*a*)(8*b*). FIG. 8A, FIG. 8B and FIG. 8C show a variety of flat, angled and radiused surfaces which are used to form the contact means (8*a*)(8*b*) which penetrate the ice (13). FIG. 4 and FIG. 9 shows a hub (4), spacer (3) and contact means ring (2). Because of the need for precise control over the configuration of the ice-engaging structure the contact means ring (2), which incorporates the entire ice-engaging structure is designed to be replaceable, thus eliminating the need for an expensive precision sharpening machine. The contact means (8*a*)(8*b*) are held on by either athreaded surface (9), a retaining device such as screws or pressed on. The wheel (1) may have relief's (15), FIG. 3, in the hub (4) for weight reduction or esthetics. The wheel (1) is attached to a standard in-line boot (17), FIG. 11 and FIG. (12) by a standard axle (18), locknut (19) and bearings (20), FIG. 10, from a in-line skate, by the bearing counterbore (14), FIG. 3

What is claimed is:

1. A wheel for use on ice comprising:

a hub and outer ring:

said hub being made of a lightweight material:

said outer ring containing ice-engaging structures:

said ice-engaging structures being made of a material that is substantially harder than ice:

said ice-engaging structures comprising of a outer circumferential contact means, inner circumferential contact means and support surface:

said outer circumferential contact means and inner circumferential means being arranged so that at least two contact means are in contact with the ice surface when the wheel is perpendicular to the ice and also when the wheel is at a predetermined angle from perpendicular to the ice:

said support surface is directly adjacent to the outer circumferential contact means and the inner circumferential contact means:

said support surface is parallel to a line intersecting the outer periferal edges of said adjacent outer circumferential contact means and the adjacent inner circumferential contact means.

2. The wheel of claim 1, wherein said hub further comprises a bore and counterbore, on each side, to accommodate an axle and bearings.

3. The wheel of claim 1, wherein said wheel is interchangeable with a standard wheel of a standard in-line skate.

4. The wheel of claim 1, wherein said ice-engaging structures are removable from said hub.

5. The wheel of claim 1, wherein there is a minimum distance between the said outer circumferential contact means and the inner circumferential contact means in relationship to the distance from the support surface to a line intersecting the outer peripheral edges of said adjacent outer circumferential contact means and the adjacent inner circumferential contact means.

* * * * *